US008955766B2

(12) United States Patent
Hertwig et al.

(10) Patent No.: US 8,955,766 B2
(45) Date of Patent: Feb. 17, 2015

(54) HEATABLE INJECTOR FOR FUEL INJECTION IN AN INTERNAL COMBUSTION ENGINE

(71) Applicant: Dr. Ing. h.c. F. Porsche Aktiengesellschaft, Stuttgart (DE)

(72) Inventors: Marko Hertwig, Dinkelsbuehl (DE); Andreas Nauwerck, Vaihingen an der Enz (DE); Matteo Skull, Stuttgart (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 0 days.

(21) Appl. No.: 14/193,318

(22) Filed: Feb. 28, 2014

(65) Prior Publication Data

US 2014/0252122 A1 Sep. 11, 2014

(30) Foreign Application Priority Data

Mar. 6, 2013 (DE) ..... 10 2013 102 219

(51) Int. Cl.
*B05B 1/24* (2006.01)
*F02M 53/06* (2006.01)

(52) U.S. Cl.
CPC ..... *F02M 53/06* (2013.01)
USPC ..... 239/133; 239/135; 239/585.5

(58) Field of Classification Search
USPC ..... 239/132, 133–138, 533.2–533.12, 239/585.1–585.5
See application file for complete search history.

(56) References Cited

U.S. PATENT DOCUMENTS

| | | | | |
|---|---|---|---|---|
| 4,620,516 | A | 11/1986 | Reüm et al. | |
| 5,758,826 | A * | 6/1998 | Nines | 239/136 |
| 5,915,626 | A | 6/1999 | Awarzamani et al. | |
| 6,109,543 | A * | 8/2000 | Bright et al. | 239/135 |
| 6,422,481 | B2 * | 7/2002 | Ren et al. | 239/13 |
| 6,578,775 | B2 * | 6/2003 | Hokao | 239/135 |
| 6,592,052 | B2 * | 7/2003 | Hokao | 239/135 |
| 6,779,513 | B2 * | 8/2004 | Pellizzari et al. | 123/549 |
| 7,225,998 | B2 * | 6/2007 | Pellizzari | 239/136 |
| 7,387,263 | B2 * | 6/2008 | Yasukawa et al. | 239/5 |
| 7,472,839 | B2 * | 1/2009 | Yasukawa et al. | 239/135 |
| 7,481,376 | B2 * | 1/2009 | Hornby et al. | 239/5 |

(Continued)

FOREIGN PATENT DOCUMENTS

| | | | |
|---|---|---|---|
| DE | 3307109 | A1 | 3/1984 |
| DE | 19629589 | A1 | 1/1998 |

(Continued)

OTHER PUBLICATIONS

German Search Report corresponding to German counterpart patent application No. DE10 2013 102 219.7, dated Oct. 28, 2013, with partial English translation.

*Primary Examiner* — Christopher Kim
(74) *Attorney, Agent, or Firm* — RatnerPrestia

(57) ABSTRACT

A heatable injector for fuel injection in an internal combustion engine, the injector having an injector housing, a fuel space which is situated inside the injector housing, an adjustable injector needle which is arranged in the injector housing for opening and closing a fuel discharge opening of the injector housing, and a heating device which is arranged inside the injector housing with a heating element for heating the fuel which is situated in the fuel space. The heating element is configured as a coating of a boundary face of the injector with respect to its fuel space, the coating being composed of a carbon nanoparticle material.

10 Claims, 1 Drawing Sheet

(56) References Cited

U.S. PATENT DOCUMENTS

| | | | | |
|---|---|---|---|---|
| 7,766,254 | B2 * | 8/2010 | Trapasso et al. | 239/135 |
| 8,256,691 | B2 * | 9/2012 | Bolz et al. | 239/135 |
| 8,655,246 | B2 * | 2/2014 | Tokuda et al. | 399/329 |
| 8,695,901 | B2 * | 4/2014 | Hornby et al. | 239/585.1 |
| 2010/0034921 | A1 | 2/2010 | Bolz et al. | |
| 2011/0089257 | A1 | 4/2011 | Brichzin et al. | |
| 2012/0055453 | A1 | 3/2012 | Dong | |

FOREIGN PATENT DOCUMENTS

| | | | |
|---|---|---|---|
| DE | 10045753 | A1 | 3/2002 |
| DE | 10355039 | A1 | 7/2005 |
| DE | 102009050288 | A1 | 4/2011 |
| EP | 2100028 | B1 | 6/2008 |
| EP | 2385240 | A1 | 11/2011 |
| GB | 2206378 | A | 1/1989 |

* cited by examiner

HEATABLE INJECTOR FOR FUEL INJECTION IN AN INTERNAL COMBUSTION ENGINE

CROSS-REFERENCE TO RELATED APPLICATIONS

This application claims priority to German Patent Application No. DE 10 2013 102 219.7, filed Mar. 6, 2013, which is incorporated by reference herein in its entirety.

FIELD OF THE INVENTION

The invention relates to a heatable injector for fuel injection in an internal combustion engine, the injector having an injector housing, a fuel space which is situated inside the injector housing, an adjustable injector needle which is arranged in the injector housing for opening and closing a fuel discharge opening of the injector housing, and a heating device which is arranged inside the injector housing with a heating element for heating fuel which is situated in the fuel space.

BACKGROUND OF THE INVENTION

A heating element of this type on the injector serves the purpose of raising the fuel temperature, with the result that fuel can be injected into a combustion chamber of the internal combustion engine in a gaseous state. This results in improved mixing of the evaporated fuel with oxygen in the combustion chamber. In addition, condensation of the mixture on combustion chamber walls is prevented and the formation of soot particles is minimized.

A heatable injector of the type mentioned at the outset which is used in a compression-ignition internal combustion engine is known from DE 100 45 753 A1, which is incorporated by reference in its entirety. Here, the injector has a heating device which is arranged inside the injector housing in a region in front of the fuel discharge opening for heating fuel which is situated in the fuel space. Here, the heating element of the heating device makes direct contact with the fuel. The heating device has, for example, an annularly arranged resistance heating element; however, semiconductor heating elements or inductive heating elements can also be provided. The heating device is capable of heating the fuel which is situated in the fuel space, with the result that said fuel has a defined temperature before the opening of the fuel discharge opening by transferring the injector needle into its open position and the subsequent injection of the fuel into the combustion chamber of the internal combustion engine. Said defined temperature can be approximately from 100° C. to 400° C. A temperature sensor is provided in the fuel space. Said temperature sensor serves to regulate the temperature of the injected fuel by means of a control and regulating device.

DE 196 29 589 A1, which is incorporated by reference in its entirety, describes a heatable injector for fuel injection in an internal combustion engine. In said heatable injector, a magnet coil is provided for adjusting an injector needle which serves to open and close a fuel discharge opening of the injector. Here, the thermal power loss which is produced in any case by the magnet coil is utilized to preheat the fuel. Furthermore, the injector has a heating coil for additionally heating the fuel which flows through the fuel discharge opening.

EP 2 100 028 B1, which is incorporated by reference in its entirety, describes a heatable injector for fuel injection in an internal combustion engine, in which heatable injector an inductively heatable heating element is integrated into a fuel space of the injector, which heating element is configured as a track which is folded in a zigzag shape between an injector housing and an injector needle and forms a hollow cylinder which extends in the axial direction. As a result, a great heat transfer area can be realized between the heating element and the fuel.

EP 2 385 240 A1, which is incorporated by reference in its entirety, has disclosed a heatable injector for fuel injection in an internal combustion engine, in which heatable injector a heating device is used with a heating element which is composed of a thick-film material. Said thick-film material is applied to the outer side of an injector housing, with the result that, during heating of the heating element, heat is dissipated from the injector housing to the fuel which is situated in a fuel space between the injector housing and an injector needle.

GB 2 206 378 A, which is incorporated by reference in its entirety, has disclosed a heatable injector for fuel injection of an internal combustion engine, in which heatable injector a heating device and a thermocouple are arranged in the interior of the injector.

SUMMARY OF THE INVENTION

Described herein is a heatable injector of the type mentioned at the outset having particularly satisfactory heating properties, an optimum heat transfer to the fuel, and a structurally simple design.

The heating element is configured as a coating of a boundary face of the injector with respect to its fuel space, the coating being composed of a carbon nanoparticle material.

As a result of the use of a coating of this type as heating element, and therefore as a result of the use of a thin-walled, homogeneous heating element, existing injector forms, that is to say, in particular, injectors which are on the market and are not heatable, can be modified in a virtually unchanged manner for the function of heatability of the injector. Moreover, the coating forms a homogeneous contact over a large surface area with the fuel, with the result that an optimized heat transfer to the fuel is ensured.

The injector according to aspects of the invention is used, in particular, in an internal combustion engine which is configured as a gasoline engine with direct injection. Very strict exhaust gas standards are to be adhered to in engines of this type, with very low soot and HC emissions and a low limiting value for the particle mass PM and the particle number PN. The mixture formation and emissions during cold starting are of particular significance in this context. The time period during cold starting in the driving cycle is particularly critical. Most of the emissions are emitted here. This is due to the fact that the mixture regulation (lambda probe) is not yet active and the catalytic converter is too cold to effectively convert pollutants. The reduction of the raw emissions is therefore the main aim during cold starting. The injector according to aspects of the invention can also be used in compression-ignition internal combustion engines.

The design according to aspects of the invention of the injector makes a sustained reduction in emissions possible. By means of the heating device which is used, the fuel is already superheated before the first injection to such an extent that it evaporates suddenly during the injection and is available in vapor form during the mixture formation and combustion. A critical advantage is the ideal mixture preparation (homogenization) and the reduction of wall deposits which contribute to the improvement of the HC and soot emissions.

On account of the low layer thickness, for example a layer thickness of approximately 0.1 mm, the carbon heating coating can be integrated into injector layouts which already exist. The coating can be applied in the interior of the injector housing by dipping or painting as early as during the production of the injector, in particular during the production of the fuel space in the injector housing, insofar as the injector housing is to be provided with the coating. A very satisfactory heat transfer is ensured by the direct contact of the heating surface with the fuel. At the same time, the reservoir of the injector can act as an insulator, in order not to dissipate the heat directly to the surrounding components.

It is provided, in particular, that the boundary face of the injector is a face of the injector housing which adjoins the fuel space. The coating is therefore applied to the injector housing of the injector. In principle, however, the coating could also be applied to other components of the injector, as long as it is ensured that the coating, that is to say the heating element, adjoins the fuel space directly, that is to say fuel which is situated in the fuel space makes direct contact with the coating. The coating is preferably arranged so as to run completely around the injector needle. If the injector housing is provided with the coating, the coating extends, in particular, so as to run completely around the injector needle.

It is considered to be particularly advantageous if the coating extends over a relatively large length of the fuel space. The coating is preferably arranged substantially over the entire length of the injector needle.

The coating is applied, in particular, in a thermocoating process.

A voltage supply for the heating device can be brought about in different ways. For instance, the injector has, for example, a voltage supply for the heating device which is independent of the voltage supply for an electromagnet for adjusting the injector needle. Secondly, there is the possibility to design the injector in such a way that it has a voltage supply for the heating device, which voltage supply is the voltage supply of the electromagnet for adjusting the injector needle. Here, in particular, means for reversing the polarity of the voltage supply are provided. The voltage supply takes place to the electromagnet in a first defined polarity and the voltage supply takes place to the heating device in a second defined polarity. As an alternative, the voltage supply can be performed without cables by way of induction without opening the high pressure space.

In the cases which are described, the voltage supply can therefore be carried out either via a separate supply cable which is integrated into the injector or via the voltage supply for the solenoid valve of the injector. In the last-mentioned case, the solenoid valve will advantageously be able to be opened only with a defined polarity at the plug. In the case of a polarity reversal, for example, the solenoid valve can be shut by way of a diode and the applied energy can be transmitted to the carbon coating. Since the heating of the injector has effects on the exhaust gas emissions, in particular, before starting the engine, a polarity reversal during driving can be omitted. The heating of the injector can be started as early as when the vehicle is opened via remote control or a hands-free zone is entered. This ensures that sufficient time is available, in order to heat the injector to the target temperature.

The internal combustion engine is, in particular, of the type which is used in a passenger motor vehicle or commercial vehicles.

The heatable injector according to aspects of the invention and its developments contain a multiplicity of advantages. For instance, the carbon nanoparticle material is integrated as heating element into the interior of the injector. As a result, the injector can be coated with said material in the interior of the reservoir as early as during the production. Existing injector forms can remain virtually unchanged as a result of the use of said material. Furthermore, a very satisfactory heat transfer is ensured at by the direct contact with the fuel.

The configuration of the heating element as a coating makes homogeneous heating without hot spots possible. This is possible with very low layer thicknesses of, for example, 0.1 mm. Any desired contours can be coated and heated. Temperatures of up to 500° C. are possible here. The heating device can be operated with a low voltage of 12 V/24 V. A conductivity of up to R=1 ohm can be realized, as a result of which a high thermal output can be realized.

The coating is composed, in particular, of a binder matrix and a carbon formulation which is adapted to the carrier material.

BRIEF DESCRIPTION OF THE DRAWING

Further features of the invention result from the subclaims, the appended drawing and the description of the preferred exemplary embodiment which is illustrated in the drawing, without being restricted thereto.

In the drawing.

DETAILED DESCRIPTION OF THE INVENTION

Figure 1:
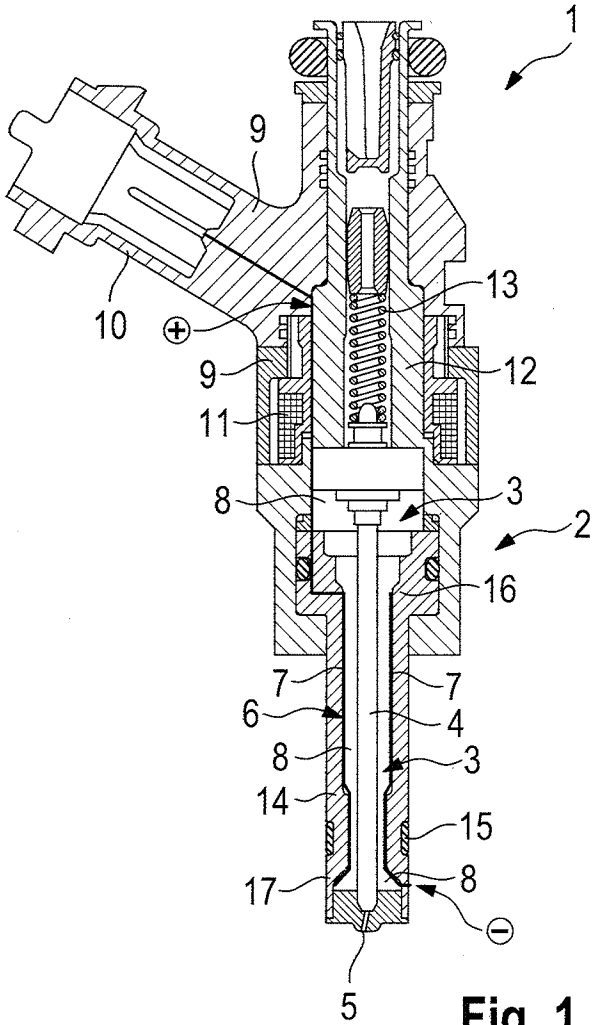
FIG. 1 shows a longitudinal center section through a heatable injector for fuel injection in an internal combustion engine.

The injector 1 which is illustrated in FIG. 1 is used for fuel injection in an internal combustion engine, which is a direct injection gasoline internal combustion engine. It is provided with injectors according to aspects of the invention which are assigned to the respective cylinders of the internal combustion engine. The internal combustion engine is installed, for example, in a passenger motor vehicle.

The injector 1 has an injector housing 2, a fuel space 3 which is situated inside the injector housing 2, an adjustable injector needle 4 which is arranged in the injector housing 2 for opening and closing a fuel discharge opening 5 of the injector housing 2, and a heating device 6 which is arranged inside the injector housing 2 with a heating element 7 for heating the fuel 8 which is situated in the fuel space 3.

The injector housing 2 is configured in two pieces. A first housing part 9 receives a plug 10 for connection to a complementary electric plug part (not illustrated) and, furthermore, a magnet coil 11 which interacts with an armature 12 for loading the injector needle 4 for the purpose of opening and closing the fuel discharge opening 5. A compression spring 13 is in an operative position with the injector needle 4, which compression spring 13 prestresses the injector needle 4 into its position which closes the fuel discharge opening 5. By way of activation of the electric magnet, that is to say activation of the coil 11, the injector needle is transferred counter to the force of the compression spring 13 into its open position, in which the injector needle 4 opens the fuel discharge opening 5, with the result that fuel 8 can exit via said fuel discharge opening 5 into a combustion chamber (not illustrated) of the internal combustion engine.

The second housing part 14 of the injector housing 2 is plugged in a sealed manner into the first housing part 9. In the region of the injector needle 4, said housing part 14 has a substantially constant internal diameter, apart from a region with a further reduced internal diameter, where the housing part 14 is provided with an outer groove, into which a sealing ring 15 is inserted. The sealing ring 15 seals the injector 1 and the housing part 14 in that region of the cylinder head, from which the housing part 14 protrudes, in the region of its free end and which has the fuel discharge opening 5, into the combustion chamber from the cylinder head.

The heating element 7 is configured as a coating of a boundary face of the injector 1 with respect to its fuel space 3. In specific terms, the inner face of the housing part 14 is provided with the heating element 7 or the coating in that region which has the above-described, substantially constant internal diameter. The coating is arranged between the marked ends 16 and 17 according to the illustration in FIG. 1. The coating is arranged so as to run completely around the injector needle 4 and substantially over the entire length of the injector needle 4. The coating is applied to the housing part 14 in a thermocoating process. The coating is composed of a carbon nanoparticle material.

The voltage supply of the heating element 7 is illustrated by the electric polarities "+" and "−". Said voltage supply can be one which is independent of the voltage supply for the electromagnet, that is to say the coil 11 for adjusting the injector needle 4. Said independent voltage supply is shown for the exemplary embodiment according to FIG. 1.

Figure 2:
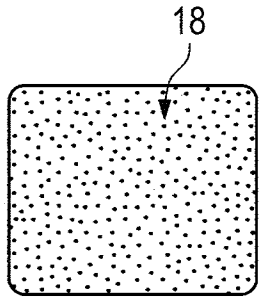
FIG. 2 shows the illustration of heat radiation of a heating element which is used in the injector and is configured as a coating which is applied using the thermocoating process.

FIG. 2 shows the heat radiation 18 of the heated coating which is produced by means of the thermocoating process. It is illustrated that, in the case of a heating element which heats or a coating which heats, heat is emitted homogeneously from the heating element 7. This spatially homogeneous emitting of the heat over the entire area of the heating element 7 differs from the inhomogeneous emitting of heat of a heating element which is formed from individual heating wires.

LIST OF DESIGNATIONS

1 Injector
2 Injector housing
3 Fuel space
4 Injector needle
5 Fuel discharge opening
6 Heating device
7 Heating element
8 Fuel
9 Housing part
10 Plug
11 Coil
12 Armature
13 Compression spring
14 Housing part
15 Sealing ring
16 End
17 End
18 Heat radiation

What is claimed:

1. A heatable injector for fuel injection in an internal combustion engine, the injector having an injector housing, a fuel space which is situated inside the injector housing, an adjustable injector needle which is arranged in the injector housing for opening and closing a fuel discharge opening of the injector housing, and a heating device which is arranged inside the injector housing with a heating element for heating the fuel which is situated in the fuel space, wherein the heating element is configured as a coating of a boundary face of the injector with respect to the fuel space, the coating being composed of a carbon nanoparticle material.

2. The heatable injector as claimed in claim 1, wherein the boundary face is a face of the injector housing which adjoins the fuel space.

3. The heatable injector as claimed in claim 1, wherein the coating is arranged so as to run completely around the injector needle.

4. The heatable injector as claimed in claim 1, wherein the coating is arranged substantially over an entire length of the injector needle.

5. The heatable injector as claimed in claim 1, wherein the coating is a coating which is applied in a thermocoating process.

6. The heatable injector as claimed in claim 1, wherein the injector has a voltage supply for the heating device, which voltage supply is independent of a voltage supply for an electromagnet for adjusting the injector needle.

7. The heatable injector as claimed in claim 1, wherein the injector has a voltage supply for the heating device, which voltage supply is the voltage supply of the electromagnet for adjusting the injector needle, means for reversing the polarity of the voltage supply of the heating device being provided, the voltage supply of the heating device taking place to the electromagnet in a first defined polarity and the voltage supply taking place to the heating device in a second defined polarity.

8. The heatable injector as claimed in claim 1, wherein the injector has control means which switch on the heating device when a control pulse is detected.

9. The heatable injector as claimed in claim 8, wherein the control pulse is an opening of a passenger motor vehicle which includes the internal combustion engine.

10. The heatable injector as claimed in claim 9, wherein the control pulse corresponds to entering of a hands-free zone of the vehicle.

* * * * *